United States Patent [19]

Chapman et al.

[11] 4,160,348

[45] Jul. 10, 1979

[54] INTERIOR STORM WINDOW CONSTRUCTION

[75] Inventors: Harvey A. Chapman, Richfield; John S. Fowler; John C. P. Huang, both of Roseville, all of Minn.; James B. Leslie, Wheatridge, Colo.

[73] Assignee: Minnesota Mining and Manufacturing Company, St. Paul, Minn.

[21] Appl. No.: 852,059

[22] Filed: Nov. 16, 1977

[51] Int. Cl.[2] ..... E06B 3/26

[52] U.S. Cl. ..... 52/202; 52/403; 160/354

[58] Field of Search ..... 52/171, 202, 203, 616, 52/397, 403, 788; 160/369, 354; 49/61, 62, 501

[56] References Cited

U.S. PATENT DOCUMENTS

| | | | |
|---|---|---|---|
| 2,612,947 | 10/1952 | Jenks | 160/354 X |
| 2,923,351 | 2/1960 | Zitomer | 49/61 X |
| 2,999,279 | 9/1961 | Lauer | 160/369 X |
| 3,158,909 | 12/1964 | Downs | 52/202 |
| 3,530,618 | 9/1970 | Grossman | 49/501 |
| 3,681,179 | 8/1972 | Theissen | 161/4 |
| 3,991,806 | 11/1976 | Abell | 160/90 |
| 4,016,695 | 4/1977 | Stoakes | 52/403 X |
| 4,042,004 | 8/1977 | Kwan | 49/501 X |

*Primary Examiner*—Price C. Faw, Jr.
*Assistant Examiner*—Carl D. Friedman
*Attorney, Agent, or Firm*—Cruzan Alexander; Donald M. Sell; John C. Barnes

[57] ABSTRACT

An interior storm window construction which is formed with a pair of identical window sashes affording the reversal of the window sashes and a frame comprised of four frame members, three of which are identical in cross section and one of which varies in depth to permit easy insertion and removal of the window sash from the frame. The frame members are formed to be easily adapted to out of square existing window casings. Each of the window panes of the window sashes are coated on one surface with a reflective material, the material on each window pane of the window construction being on a surface which is opposite the coated surface of the other window pane. Each window sash is adapted to slide within the frame formed by said frame members and they interlock along an adjacent edge to afford a seal and support along said locking edge.

8 Claims, 9 Drawing Figures

INTERIOR STORM WINDOW CONSTRUCTION

BACKGROUND OF THE INVENTION

1. Field of the Invention

The present invention relates to an improved interior storm window construction and more particularly to a storm window construction which will be easily mounted in an existing window casement and which will reduce heat loss from the room in the winter and reduce the solar heat gain in the room in the summer.

2. Description of the Prior Art

It has been known in the prior art to insert a storm window inside the window casement for the purpose of reducing heat loss and to facilitate insulating the window area because the installer need not be exposed to the weather. Earlier storm window constructions are illustrated in e.g., U.S. Pat. No. 3,991,806, issued Nov. 16, 1976 to Mr. Abell. This patent discloses a frame which may be fixed within a window casement and which is adapted after the frame is installed to receive one or more thin clear flexible plastic membranes to form insulating dead air spaces between the window pane and the interior of the room. As illustrated in U.S. Pat. No. 3,991,806, the plastic membrane storm window may be inserted into the frame by a bead strip which solves the problem for out of square window openings in the existing casement. This structure, however, will not afford a reversal of the film if desired for the purpose of directing one surface of the film toward or away from the solar radiation which may be entering the room. The patent also fails to provide any such teaching.

U.S. Pat. No. 2,834,071, issued May 13, 1958 to Camerino discloses an auxiliary window framing structure wherein the frame can be adjusted and fitted as an auxiliary window in various sized openings. This is achieved by using a perimetrical channel of sufficient depth to receive a substantial portion of a strip member. The strip members provided are preferably not received to the full depth of the channel but normally project only part way therein. This arrangement provides a fitting of the auxiliary window unit in a standard sized window opening. Where the window opening is an odd size, either smaller or larger than the standard size, the strips forming the frames may be adjusted to properly fit the window opening. They may be pressed further in the channel or drawn further out of the channel as may be required to increase or decrease the overall size of the auxiliary window frame. U.S. Pat. No. 2,834,071 thus provides a teaching of utilizing frame pieces received within a channel to adjust window frames to various sized window openings. In the present invention however the supporting strips shown in one embodiment are adapted to be fully inserted in the receiving channel with all sized window openings and the strips are cut to the selected height to provide the proper support for the window frame and to adequately seal the window frame within the window casement.

A patent which teaches the use of a heat reflective coating on a material positioned over a window is described in U.S. Pat. No. 2,774,421, issued Dec. 18, 1956 to Lion. This patent teaches the use of a shade for the window of a room which is formed of flexible material and which can be positioned over the window to cause a reflection of infrared rays. This patent, however, does not teach a fastening of the film to the window to afford the formation of an insulating barrier of dead air space and it does not provide any teaching of reversing the film to have it be effective for preventing the escape of the radiation when the room is warm.

The present invention thus provides a solution to the problem for homes which are not provided with an existing storm window structure as in climates where the normal temperature does not get below 10° F. It is necessary, however, in view of the need to conserve energy that steps be taken to prevent the movement of heat through all windows.

The present invention provides a means by which a storm window can be easily added in existing window assemblies to provide the added insulation of a storm window. Further, the present invention provides a window construction which may be adaptable to out of square or odd shaped window assemblies to make installation much easier and the cost of the window more economical.

Further, the proposed storm window construction is less expensive and more economical in that the window sashes are identical.

Further, the present invention affords a storm window construction where the window sashes are identical and thus when coated to reflect radiation will permit the window to be reversed in the frame, wherein it can further conserve energy by restricting the heating effects of the sun in the hot summer months and restrict the escape of heat from a room in the winter months and allow the solar heat to enter.

SUMMARY OF THE INVENTION

The present invention is directed to an interior storm window construction which may be applied to an existing window assembly. This window construction comprises a pair of identical window sashes which are adapted to fit in a frame and slide with respect to each other. The window sashes are formed to seal and support each other along the central edge and the window sashes may be reversed to move a coated surface on each of the window panes from an interior position to an outer position with respect to the window assembly. The frame is constructed of four polymeric extruded frame members. Three of the four frame members are identical in cross section and are joined at their ends to form the window frame to fit the window casement. The fourth frame member is of different cross section and greater in depth to permit the insertion and removal of the window sashes from the final frame. Each of the frame members are formed with a pair of parallel channels which receive the window sashes and afford a seal about the edges of the window sashes. The frame members are provided with means which afford the fitting of the frame to out of square window casements or inclined window sill members.

BRIEF DESCRIPTION OF THE DRAWING

The present invention will be more fully understood after reading the following detailed description which refers to the accompanying drawing wherein.

DETAILED DESCRIPTION OF THE INVENTION

Figure 1:
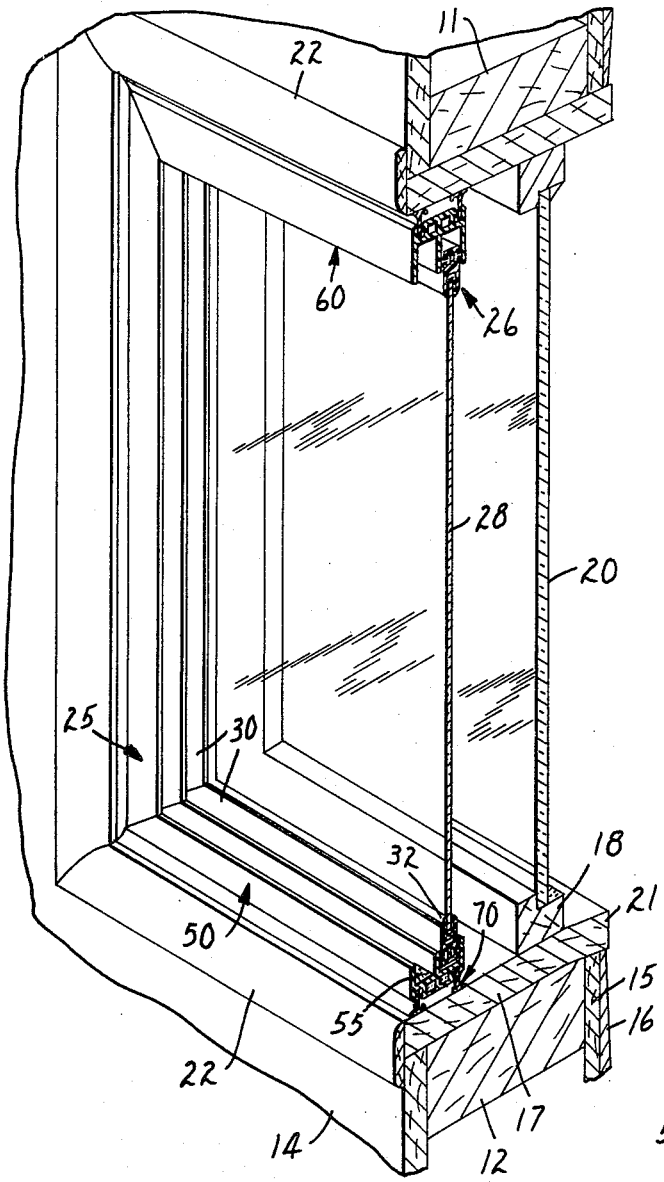
FIG. 1 is a perspective view of a cutaway portion of a window casement showing a storm window constructed according to the present invention positioned on the interior side of a wall.

The drawing illustrates a window in a wall with the upper and lower support members 11 and 12 extending between the inside wall 14 and the sheeting 15 and siding 16 forming an outside wall. The window casement comprises a sill 17 which suports the window sash 18 including window pane 20 of glass or plastic. A sill 21 is positioned outside the window sash 18 and suitable molding strips may be positioned about the window on the inside and the outside edges of window casement as indicated at 22. The window sash 18 may be that of a double hung casement window, gliding window or picture window.

The interior storm window construction of the present invention is adapted to be installed interior of the window pane 20 and onto the window sill 17. The frame for the storm window is readily adapted to fit the window assembly and is positioned in spaced relation to the window pane to define a dead air space between the window pane 20 and the panes of the interior storm window sashes. The interior storm sashes are slidable and permit access to the exterior window and they are removable from the frame to permit cleaning etc.

Figure 2:
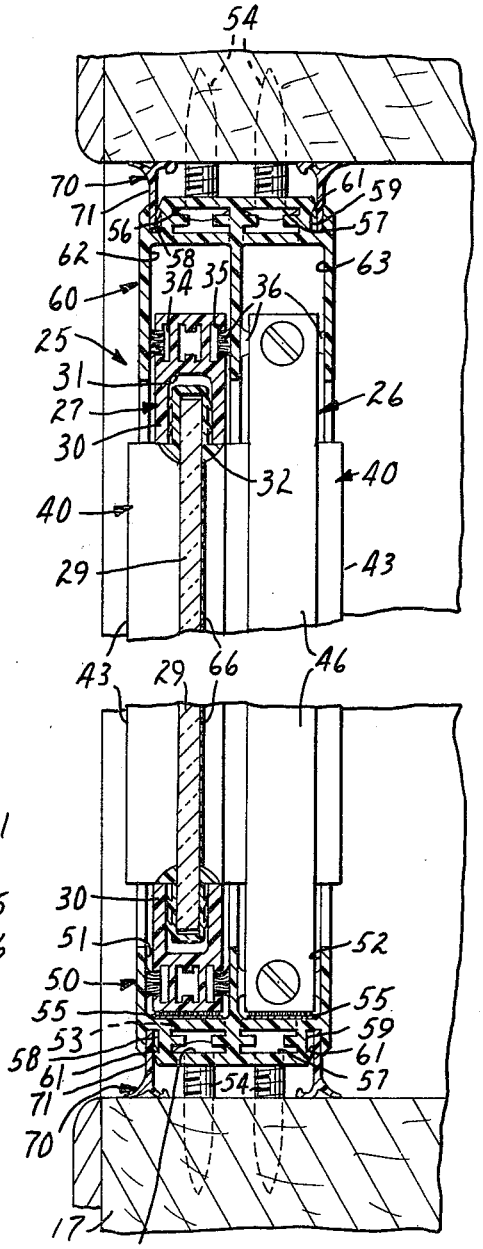
FIG. 2 is a vertical sectional view of the storm window construction of the present invention.
Figure 3:
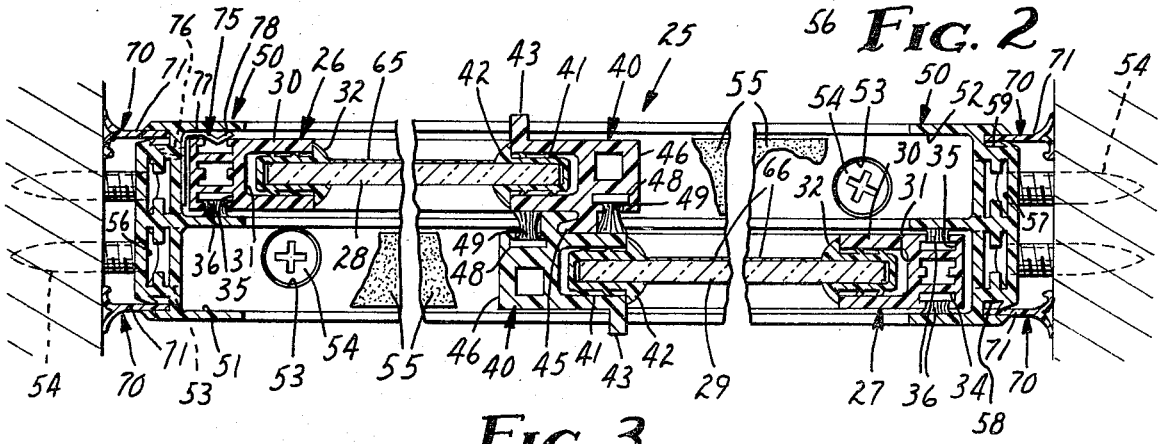
FIG. 3 is a horizontal sectional view of the storm window construction of the present invention.
Figure 4:
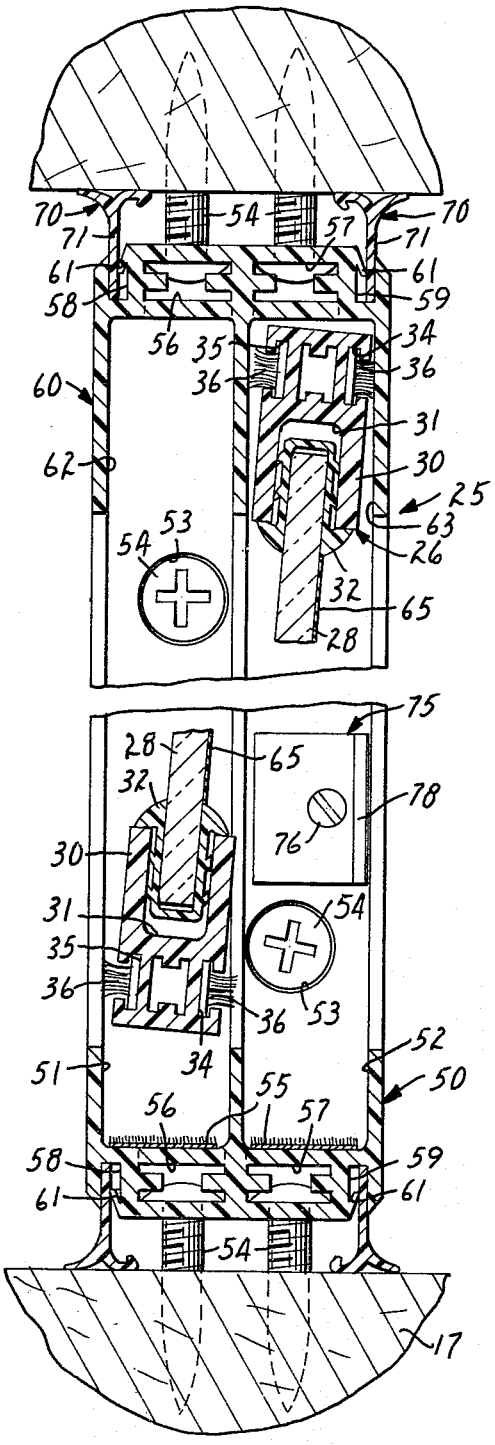
FIG. 4 is a vertical sectional view similar to FIG. 2 but showing one of the window sashes being raised and pivoted to remove the same from the frame.

The storm window assembly is generally designated by the reference numeral 25 and comprises a pair of identical window sashes 26 and 27, each having a pane 28 and 29 respectively, of glass or plastic. The window sashes are formed by three lengths of extruded polymeric material 30, identical in cross section, and a fourth length of extruded material 40 forming the mating edge for the two window sashes 26 and 27. The extruded sash frame member 30 for each window, as illustrated in FIGS. 2, 3, and 4, is an extrusion having a channel 31 of sufficient depth to receive the elastomeric channel glazing 32 which supports the window pane. Opposite the channel 31 is the sealing edge of the sash member and opposite sides of the sash member are formed with channels 34 and 35 in which is inserted a complementary length of a sealing strip 36 comprising a backing and dense fibers which strip material is a commercially available pile weatherseal strip, e.g. from the Schlegel Manufacturing Company of Rochester, New York 14601.

The sash frame member 40 which forms the fourth edge of the window sash is an extrusion which comprises a channel 41 to receive the elastomeric channel glazing 42 and which is formed with an extruded flange 43 which will serve as a handle to grasp and force the window to move in an opening or closing direction. When moved in the closing direction the extrusion 40 is formed with a lip 45 extending from the opposite side of the extrusion 40 in the direction of the open edge of the channel 41 which will receive a similar lip from the other window sash to define a seal between the two window sashes and a support for the window sashes along their adjacent edge. Toward the butt edge 46 of the extrusion 40 and spaced from the lip 45 is a channel 48 to receive a sealing strip 39 which is similar to the sealing strip 36 referred to hereinabove. A strip of polymeric material is positioned along the length of the pile centrally thereof to further restrict air flow.

The window frame is readily adapted to fit in openings which are out of square or which have inclined sills. The window frame comprises three frame members, identical in cross section, formed by extrusion of a polymeric material. These three frame members, identified by reference numeral 50, are positioned along the lower edge of the storm window assembly and on each side. The frame members 50 are mitered at the ends to form attractive corners and form continuous frames about the assembly. The frame members 50 are illustrated in cross section in FIGS. 2, 3, 4, and 5. The fourth frame member 60, to complete the window frame is also a polymeric extrusion and is shown in cross section in FIGS. 2 and 4.

The frame members 50 comprise a pair of identical parallel channels 51 and 52 through which are formed in the base thereof a number of bores 53 through which screw-type fasteners 54 may be inserted to mount the frame member 50 in the window casement. Positioned along the base of each channel 51 and 52 in the lower frame member is a tape 55 which covers the bores 53 to hide the heads of the fasteners 54 and slidably support the bottoms of the window sashes. The heads of the fasteners are retained within passageways 56 and 58 formed in the frame 50 and extending the length of the frame members. Formed on opposite sides of the passageways 56 and 57 are channels 58 and 59 which are directed oppositely from the channels 51 and 52. The channels 58 and 59 cooperate to form the means for adjusting the position of the window frame members 50 with respect to the window casement and receive the standard or stem 71 of an extruded strip 70 which affords the support for the window frames as will hereinafter be described. The channels 58 and 59 also have a lip 61 which engages the edge of the standard 71 to frictionally retain the strip 70 within the channel.

The window frame member 60 is very similar to the frame members 50 but has greater width to provide deeper channels 62 and 63, thus permitting the window sashes to be raised into the channels 62 and 63 sufficiently high to clear the flanges of channels 51 and 52 in which they normally rest against the tape 55. This permits the window sashes to be removed from the frame. In other respects the frame member 60 corresponds to the frame member 50 and is provided with the passageways 56 and 57 through which are formed the bores for the insertion of the fastening members 54 and are formed with means affording a good fit of the frame member 60 to the adjacent member of the window casement.

Figure 5:
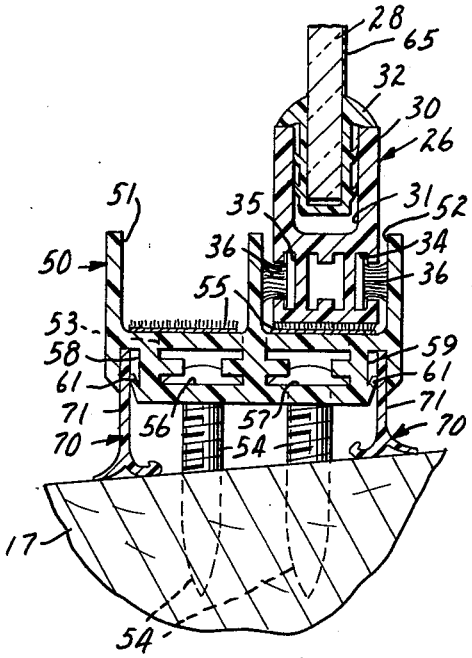
FIG. 5 is a detailed sectional view of the lower portion of the storm window assembly.

As seen most clearly in FIG. 5, when the sill member 17 is positioned at an incline, it is necessary to adjust the height of the standard 71 of the supporting strips 70 such that the base thereof can engage the surface of the casement member and the standards will fit fully into the channels 58 and 59 to rigidly support the frame member 50 or 60. This is accomplished by inserting the frame pieces after they have been mitered at the corners and secured by fastening means at said corners. The spacing between the bottom of the channel and the casement would then be measured and the shank of the strip 70 would be cut appropriately such that the strip 70 when placed in the channel fits flush against the casement member to fully support the frame. At this point the fastening members would be inserted through the bores 53 and through the bores in the other wall of the passageways 56 and 57 and placed into the casement member to secure the frame member to the casement. Also, when a window casement is out of square the shank of the strip 70 can be trimmed by varying amounts along its length to properly support the frame member from the casement members and fill the space therebetween.

A latch member is provided in the vertical channel of the outside window at one or two locations along its length. The latch member affords a frictional hold on the window casing at its edge such that movement of the inside window to its fully closed position will permit the lips 45 of the two windows to mate and form the seal. The latch member affords a sufficient holding force on the outside window so it is not moved toward an open position when the inside window is closed. The latch member illustrated is in the form of a clip 75 secured by a fastener 76 to the channel, see FIGS. 3 and 4. The clip 75 has a flange 77 with a bent end portion 78 to engage the window sash at the channel 34. This end portion 78 will engage and deform the sealing strip 36 sufficiently to hold the window closed.

Figure 7:
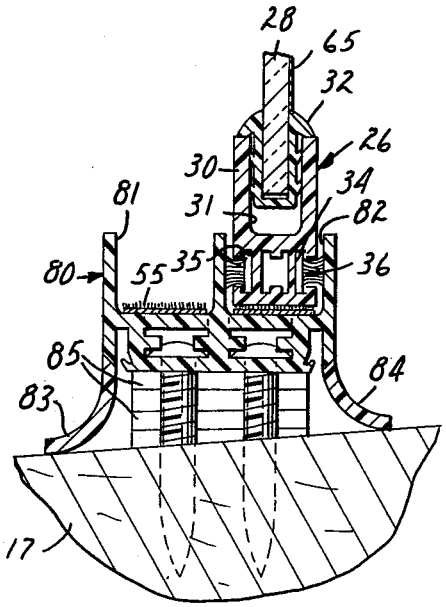
FIG. 7 is a detailed vertical sectional view of a second embodiment of the frame members of the storm window construction.
Figure 6:
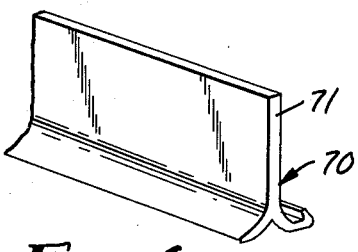
FIG. 6 is a fragmentary perspective view of a support member for the storm window construction.

An alternate form for the structure in adapting the window frame members to fit the out of square or inclined surfaces of the casement members is illustrated in FIG. 7. In this embodiment the extrusion which forms the window frame member 80 comprises a pair of parallel channels 81 and 82 to receive the window sashes 27 and 27 as illustrated in FIG. 7. The frame members however have a pair of extended side flanges which flanges conform to the surface of the casement members. These flanges 83 and 84 are pliable enough and extend from the extrusion on the side opposite the channels 81 and 82 to engage the casement member to seal thereagainst. The free edges of the flanges may be cut lengthwise along the casement member to be even and attractive along out of square frames. The flexure of the flange permits the sealing of the window frame extrusion tightly against the casement to avoid the flow of air therebetween. One or more spacers or shims 85 are positioned between the flanges and fasteners 54 to support the frame members from the casement members.

The use of identical window sashes affords the movement of a coated surface on each of the window panes 28 and 29 respectively of the window sashes 26 and 27 from one side of the storm window assembly to the other. The window pane 28 is formed with a coating 65 and the pane 29 is formed with a coating 66. The coating is preferably in the form of thin film which is adhered to the window pane 28 and 29 respectively, and bonded by a suitable adhesive. The thin film has a reflective coating suitable for reducing the transmissivity of heat through the pane. In the summer time it is desirable to block the transmission of infrared rays from the sun into a room. Therefore, the coatings 65 and 66 are disposed on the sides of the window sashes 26 and 27 directed toward the exterior window 20. In the winter it is desirable to transmit infrared rays from the sun into the room. This is accomplished then by rotating the window sashes 26 and 27 to dispose the film 65 and 66 on the interior surface of the storm windows, thus allowing the heat to enter the room while at the same time restricting heat from the room from passage through the window to the outside. Thus, the window sashes 26 and 27 being identical have the feature of permitting the two to be rotated and, in either position, they meet to lock and support each other with a seal at the joining edge. They are sealed around their edges by the channels in the frame members. Further, each of the sashes are formed with a flange 43 forming a handle permitting the sliding movement of the sashes in either rotated position.

Suitable films for use with the storm window construction of the present invention are available from Minnesota Mining and Manufacturing Company of Saint Paul, Minnesota 55101 and are identified as sun control films. The films are described in U.S. Pat. No. 3,681,179, issued Aug. 1, 1972 to D. R. Theissen. These films are optically clear flexible polymeric films having on one surface a transparent reflective metal coating on the order of 25 to 125 Angstroms thick, a transparent moisture transmitting water-insoluble protective organic coating uniformly contacting and firmly bonded to said metal coating. This film is then coated with an adhesive layer to bond it to the glass surface.

The sun control film increases the "shading" coefficient (SC) which is defined in the American Society of Heating, Refrigerating and Air Conditioning Engineers (ASHRAE) handbook of fundamentals as the ratio of the solar heat gain through virtually any glazing system to the solar heat gain through a single light of double-strength sheet glass. Thus, SC of the subject interior storm window was calculated for each of two films identified as sun control film P-18, adpated for southern regions and P-12, adapted for northern regions. Thus with the film on the surface of the interior storm window (I.S.W.) nearest the outside window or third glass surface for the summer measurement and on the fourth surface for the winter measurement the performance of the present invention appeared as set forth in the following table.

| | | | Single Glazed Window Plus I.S.W. w/Sun Control Film | |
|---|---|---|---|---|
| | Single Glazed Window | Single Glazed Window plus I.S.W. | P-18 for Southern region of USA* | P-12 for Northern region of USA** |
| For Use With Sun Control Film on 3rd Surface | 1.0 | 0.84 | 0.24 | 0.34 |
| For Winter use With Sun Control Film on 4th Surface | 1.0 | 0.84 | 0.31 | 0.45 |

-continued

| | Single Glazed Window | Single Glazed Window plus I.S.W. | Single Glazed Window Plus I.S.W. w/Sun Control Film | |
|---|---|---|---|---|
| | | | P-18 for Southern region of USA* | P-12 for Northern region of USA** |
| Increased Winter performance With Reversible Feature in % | 0 | 0 | 29% | 32% |

*Calculation is based on Dallas, Texas
**Calculation is based on St. Paul, Minnesota Another test to obtain comparative data is the air infiltration test, which test for the interior storm window of the present invention, based on ASTM-E283-73 "Rate of Air Leakage Through Exterior Windows, Curtain Walls, and Doors" produced the following data.

| Wind Velocity | ASHRAE Typical Wood Double Hung Window | ASHRAE Window Standard 90-75 | I.S.W.* of Fig. 1-6 | I.S.W.** of Fig. 7 |
|---|---|---|---|---|
| Miles/Hr | $Ft^3hr/ft$ of crack | | | |
| 25 | 57 | 30 | 23 | 20 |
| 20 | 42 | Not Available | 17 | 14 |
| 15 | 29 | NA | 11 | 9 |
| 10 | 17 | NA | 6 | 4 |

*Window frame 2' wide × 1'2" high
**Window frame 3'6" wide × 5' high

Figure 8:
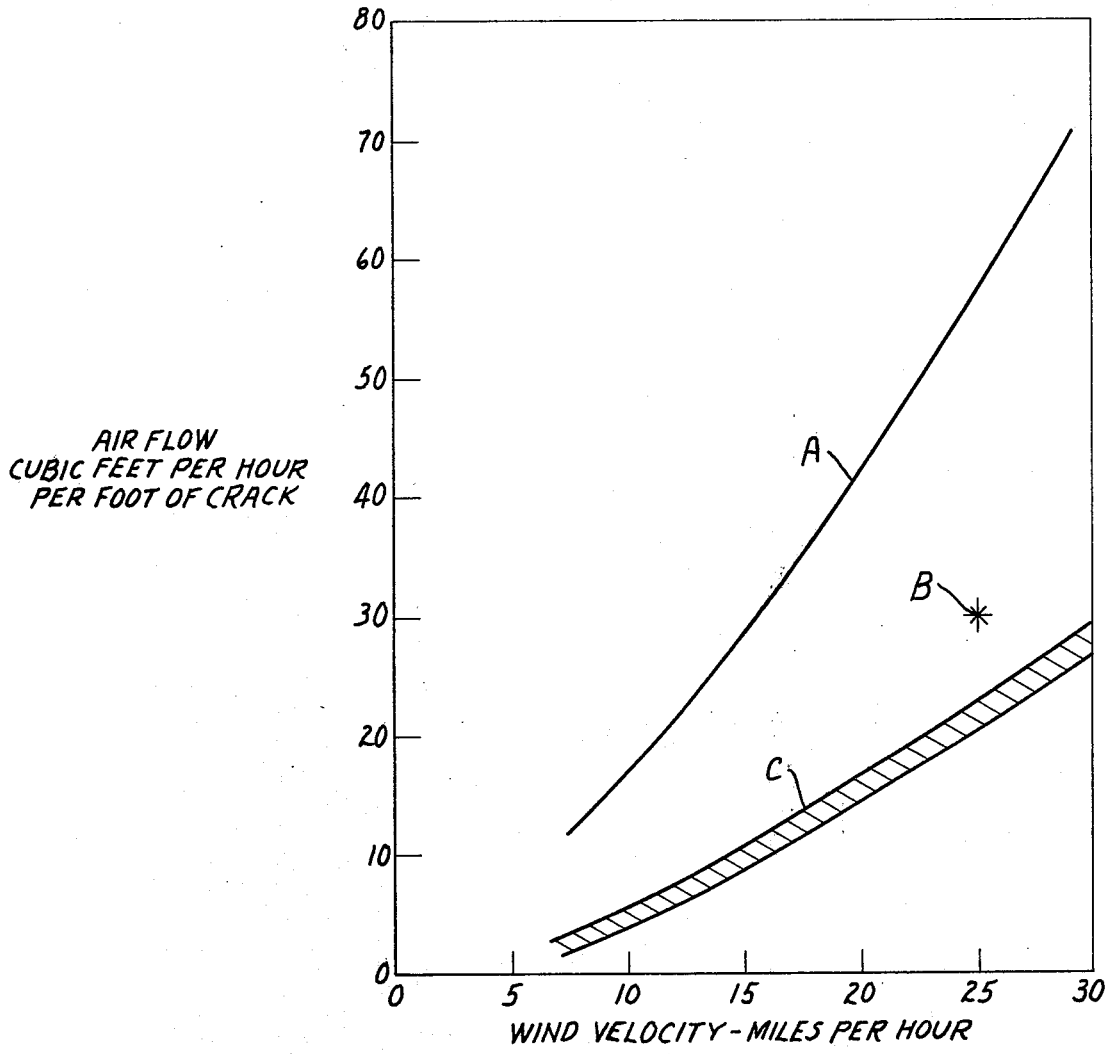
FIG. 8 is a graph plotting the air infiltration through the storm window of the present invention compared with a typical double hung window.

The figures are also plotted on the graph of FIG. 8 wherein the line designated A shows the plot of a typical wood double hung window of average fit as determined by ASHRAE. Point B on the graph shows the maximum level acceptable for ASHRAE standard 90-75 and the shaded area C indicates the range of performance of an interior storm window constructed according to the present invention. The data shows that the window of the present invention is about 30% more efficient in reducing air leakage in comparison with the ASHRAE standard 90-75 for windows. This standard, which ASHRAE released in August of 1975 is the first major voluntary consensus standard concerning energy utilization in new buildings and has been accepted into the building code of several states.

This infiltration test is made by placing the window structure in an opening, on one side of which is a closed chamber to which a vacuum pump is connected. The rate of air flow to maintain a predetermined reduced pressure is measured over a prescribed time interval.

Figure 9:
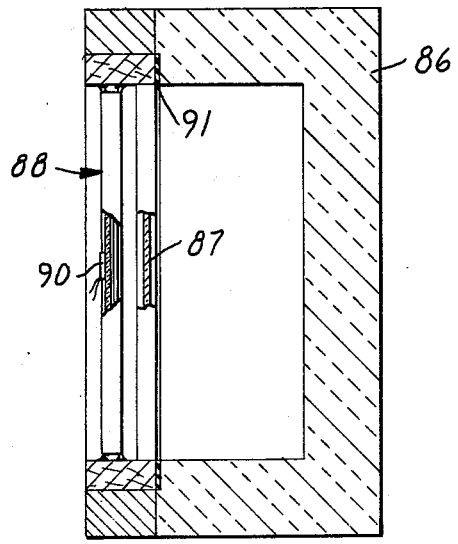
FIG. 9 is a vertical sectional view of a test fixture to measure the U-value of a window.

The U-value or heat flux through an insulation, window or wall is measured also by test. A test method used for the present invention is illustrated in FIG. 9. A constant temperature boundry was established by placing a refrigerator 86 and gasket 91 one one side of a single pane window 87 or double pane window and placing the interior storm window 88 of the type shown in FIGS. 1-6 in the opening adjacent the glass 87 and spaced therefrom more than 1 inch. Thermopile type heat flow sensors 90 were attached to the glass of the interior storm window to measure the heat flux through the window. The test was made with the refrigerator at 0° F. (−18° C.) and the laboratory at 70° F. (21° C.). The results of the tests to determine the U-value are shown in the following table and compared with the standard in the ASHRAE handbook of fundamentals:

| Storm Window Installed | ASHRAE Handbook of Fundamentals | Interior Storm Window of Fig. 7 |
|---|---|---|
| | $BTU/hr/ft^2/°F.$ | |
| On single window with air space greater than 1" | 0.55 | 0.53 |
| On typical double pane window with air space greater than 1" | 0.36 | 0.35 |

This data indicates that the U-value of the window of the present invention is equal to or better than the ASHRAE requirements.

Having thus described the present invention with respect to the accompanying drawing illustrating the preferred embodiment of the present invention it will be understood that other modifications can be made therein without departing from the spirit or scope of this invention.

What is claimed is:

1. An interior storm window construction comprising a pair of identical and reversible window sashes having window panes which sashes, when placed in a frame, will interlock at the adjacent edges to seal and provide a mutual support for the sashes, and a frame structure adapted to form the frame for the window sashes, said frame comprising four frame members which are joined together at their ends and adapted to fit in a window casement and define a rectangular opening, each of said frame members being formed of a polymeric material and being formed with a pair of parallel longitudinally extending channels adapted to receive an edge of said window sashes and said channels each having means for adjusting the position of the frame member with respect to the window casement supporting the same to seal the frame members with relation to the window casement and having openings to accommodate permanent fastening members to secure said frame members to the interior of the window casement to define a rectangular opening, one of said frame members being formed with a cross-section differing from the other three said frame members to afford a channel of increased depth for forming a top frame member.

2. An interior storm window construction according to claim 1 wherein said means for adjusting the frame members to fit the window casement comprises a pair of integral flexible conformable flanges formed on said frame members and extending therefrom opposite said channels, said flanges being adapted to engage and conform to a window casement including a casement which may be out of square, formed with inclined surfaces, and irregular surfaces.

3. An interior storm window construction according to claim 1 wherein said means for adjusting the frame members to fit a window casement comprises a strip of material having a base member and standard which strip extends the length of each said frame members, said standard being adapted to be cut lengthwise of said strip to accommodate a window casement which is not square, and said frame members being formed with slots opposite said channels for receiving the standard of said strips.

4. A storm window construction according to claim 1 wherein the window sashes are each formed with seal means cooperating with said channels to seal the window sashes within the channel and said means for adjusting said frame members from the window casement affords a dead air space between the interior side of the frame member and the exterior side of the frame members.

5. A storm window construction according to claim 1 wherein each said window pane of said pair of identical and reversible window sashes has a reflective coating on a surface of the window which surface on one window pane is opposite to the coated surface of the other window pane.

6. A storm window construction according to claim 5 wherein said coating is a transparent polymeric film having a transparent reflective metal coating and a transparent protective organic coating.

7. A storm window construction according to claim 1 wherein said frame members forming the vertical edges of said window construction are each provided with a latch member to frictionally contact the window sash as it is placed into said channels, said latch member comprising a resilient clip extending into the channel from the bight thereof to contact a side surface of the sash, whereby the sash is frictionally held to permit the interlocking of the window sashes along the adjacent edges of said sashes.

8. A storm window construction according to claim 1 wherein said window sashes have channels on opposite surfaces thereof extending along the horizontally disposed sash frame members and have sealing strips of dense fibers disposed in said channels for centering the window sashes in the channels of said frame members of said frame structure along which said sashes slide, whereby the sashes are centered in said channels.

* * * * *